US006854625B2

(12) United States Patent
Tedeschi

(10) Patent No.: US 6,854,625 B2
(45) Date of Patent: Feb. 15, 2005

(54) APPARATUS FOR FASTENING JEWELRY CLASPS

(76) Inventor: Nancy Kathryn Tedeschi, 487 Waite Rd., Rexford, NY (US) 12148

( * ) Notice: Subject to any disclaimer, the term of this patent is extended or adjusted under 35 U.S.C. 154(b) by 165 days.

(21) Appl. No.: 10/443,486

(22) Filed: May 22, 2003

(65) Prior Publication Data

US 2004/0232178 A1 Nov. 25, 2004

(51) Int. Cl.[7] ..... A47G 25/80
(52) U.S. Cl. ..... 223/111
(58) Field of Search ..... 223/111, DIG. 2, 223/1; 24/346, 455; 206/6.1; 29/428; 211/85.2; 269/37–45

(56) References Cited

U.S. PATENT DOCUMENTS 2,896,890 A * 7/1959 Hlavac ..... 248/122.1
4,734,973 A * 4/1988 Longo et al. ..... 29/428
D323,132 S * 1/1992 Grennan ..... D11/87
5,741,035 A * 4/1998 Glass ..... 294/1.1
5,785,217 A * 7/1998 Gorham, Jr. ..... 223/111
5,855,401 A * 1/1999 Papernik ..... 294/2
5,934,526 A 8/1999 Rosenbaum et al.
6,036,065 A * 3/2000 Wofford et al. ..... 223/111

* cited by examiner

*Primary Examiner*—John J. Calvert
*Assistant Examiner*—James G Smith
(74) *Attorney, Agent, or Firm*—Goodman Patenting, Inc.; George Goodman

(57) ABSTRACT

An apparatus comprising: a handle; a clasp holder mechanically coupled to the handle and adapted for holding a jewelry clasp; an eyelet holder mechanically coupled to the handle and adapted for holding a jewelry eyelet; and a clasp operator mechanically coupled to the handle and adapted for operating an operating lever of the jewelry clasp, the handle being adapted for being deformed so as to operate the operating lever and to couple the jewelry clasp with the jewelry eyelet.

14 Claims, 3 Drawing Sheets

APPARATUS FOR FASTENING JEWELRY CLASPS

BACKGROUND

The present invention relates generally to the field of apparel apparatus and more specifically to devices to aid in fastening jewelry clasps.

In a wide variety of designs, latching type jewelry clasps with spring biased operating levers are used to join the ends of bracelets and necklaces. Fastening these jewelry clasps has always been a challenging and frustrating exercise for the wearer. For bracelets, the frustration stems from the need to use just one hand to insert a jewelry eyelet attached to one bracelet end into the clasp attached to the other end while simultaneously holding the operating lever against the bias spring force to keep the clasp open. For necklaces, while two hands may be available for the task, the frustration stems from having to perform the exercise blindly, typically either behind the wearer's neck or beneath the wearer's chin.

An opportunity exists, therefore, to relieve this frustration by providing a device to aid in the fastening of such jewelry clasps.

SUMMARY

The opportunity described above is addressed, in one embodiment of the present invention, by an apparatus comprising: a handle; a clasp holder mechanically coupled to the handle and adapted for holding a jewelry clasp; an eyelet holder mechanically coupled to the handle and adapted for holding a jewelry eyelet; and a clasp operator mechanically coupled to the handle and adapted for operating an operating lever of the jewelry clasp, the handle being adapted for being deformed so as to operate the operating lever and to couple the jewelry clasp with the jewelry eyelet.

DRAWINGS

These and other features, aspects, and advantages of the present invention will become better understood when the following detailed description is read with reference to the accompanying drawings in which like characters represent like parts throughout the drawings, wherein.

DETAILED DESCRIPTION

Figure 1:
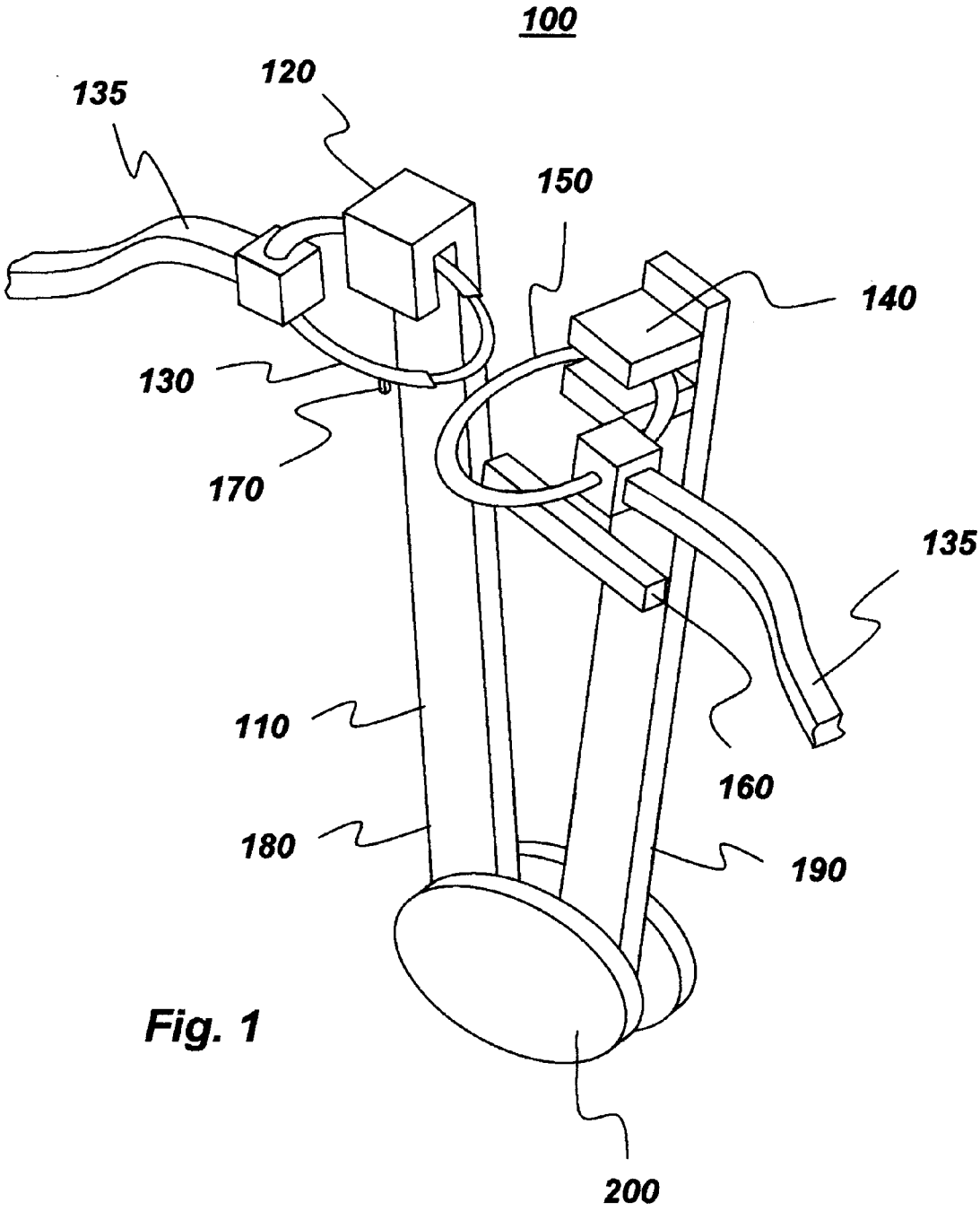
FIG. 1 illustrates an isometric schematic drawing in accordance with one embodiment of the present invention.

In accordance with one embodiment of the present invention, FIG. 1 illustrates an isometric schematic drawing of an apparatus 100 comprising a handle 110, a clasp holder 120, an eyelet holder 140, and a clasp operator 160. Clasp holder 120, eyelet holder 140, and clasp operator 160 are mechanically coupled to handle 110. In operation, clasp holder 120 holds a jewelry clasp 130 and eyelet holder 140 holds a jewelry eyelet 150. Jewelry clasp 130 and jewelry eyelet 150 are attached to opposite ends of a jewelry item 135. By deforming handle 110, clasp operator 160 is caused to operate an operating lever 170 and jewelry clasp 130 is coupled with jewelry eyelet 150. As used herein, handle 110, clasp holder 120, eyelet holder 140, and clasp operator 160 refer to any structure, device, or combination thereof capable of performing the required functions.

FIG. 1 is not drawn to any particular scale. In some embodiments in accordance with FIG. 1, handle 110 is sized large enough that a part of the wearer's body may be inserted in the opening between jewelry item 135 and handle 110. By way of example, but not limitation, jewelry item 135 may be a necklace, bracelet, or anklet, and the opening large enough to accommodate the wearer's head, hand, or foot, respectively.

In some embodiments in accordance with FIG. 1, clasp holder 120, or eyelet holder 140, or both are fashioned to allow the wearer to blindly insert, respectively, jewelry clasp 130 and jewelry eyelet 150.

In some embodiments in accordance with FIG. 1, clasp holder 120, eyelet holder 140, and clasp operator 160 are integral with handle 110. As used herein, "integral with" refers to being made of a single piece of material as would result, by way of example, but not limitation, from casting, molding, or injection molding.

In a more detailed embodiment in accordance with the embodiment of FIG. 1, handle 110 further comprises a clasp arm 180 mechanically coupled to clasp holder 120 and an eyelet arm 190 mechanically coupled to eyelet holder 140 and to clasp arm 180. In some embodiments, apparatus 100 further comprises a handle spring 200. Handle spring 200 applies an opening force to clasp arm 180 and eyelet arm 190.

Figure 2:
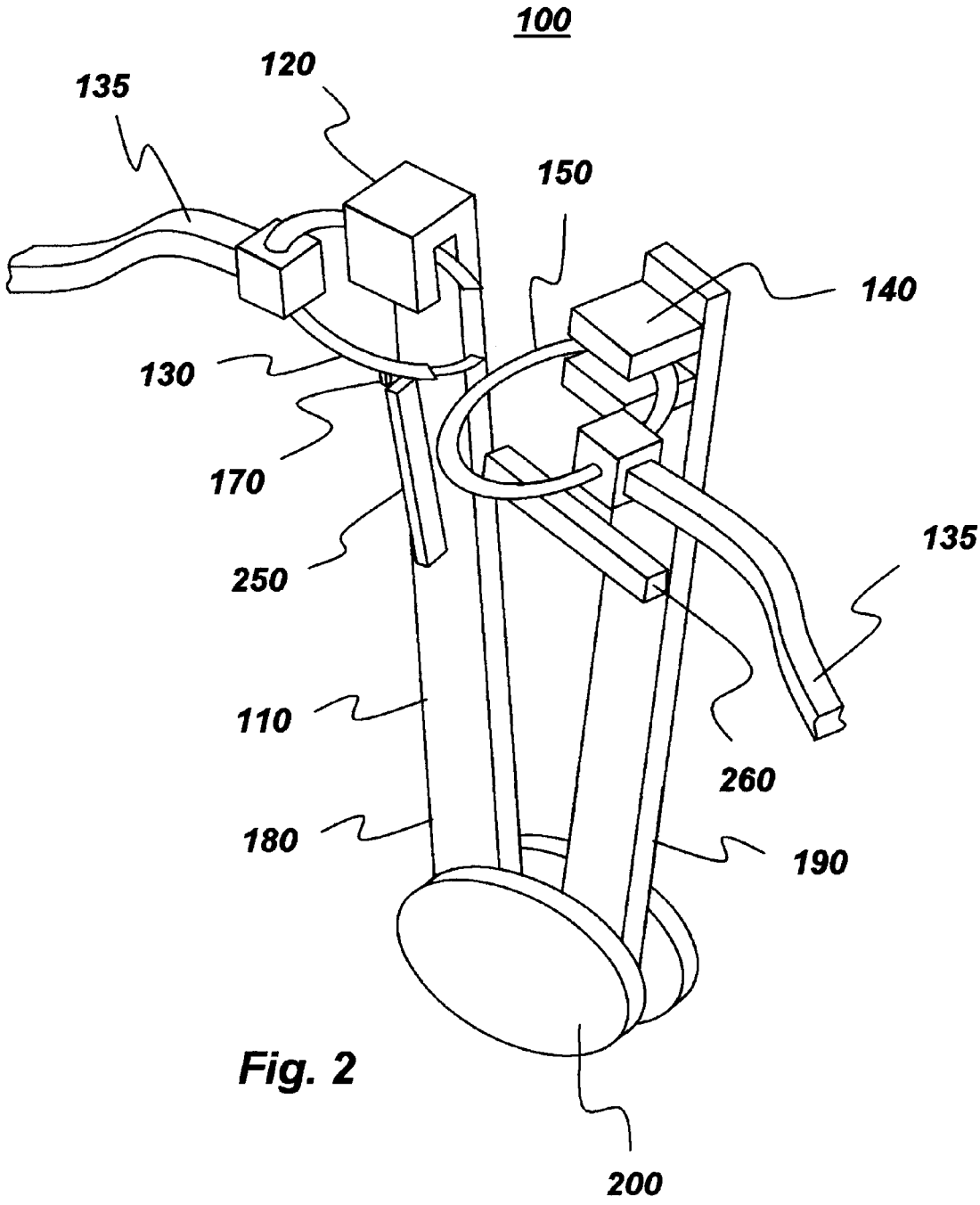
FIG. 2 illustrates an isometric schematic drawing in accordance with a more detailed embodiment of the embodiment of FIG. 1.

In accordance with a more detailed embodiment of the embodiment of FIG. 1, FIG. 2 illustrates an isometric schematic drawing of apparatus 100 wherein clasp operator 160 comprises an operating linkage 250 and an actuator 260. In operation, operating linkage 250 operates operating lever 170 and actuator 260 actuates operating linkage 250.

In some embodiments in accordance with the embodiment of FIG. 2, operating linkage 250 holds operator lever 170 in an open position and releases operating lever 170 when actuated by actuator 260.

Figure 3:
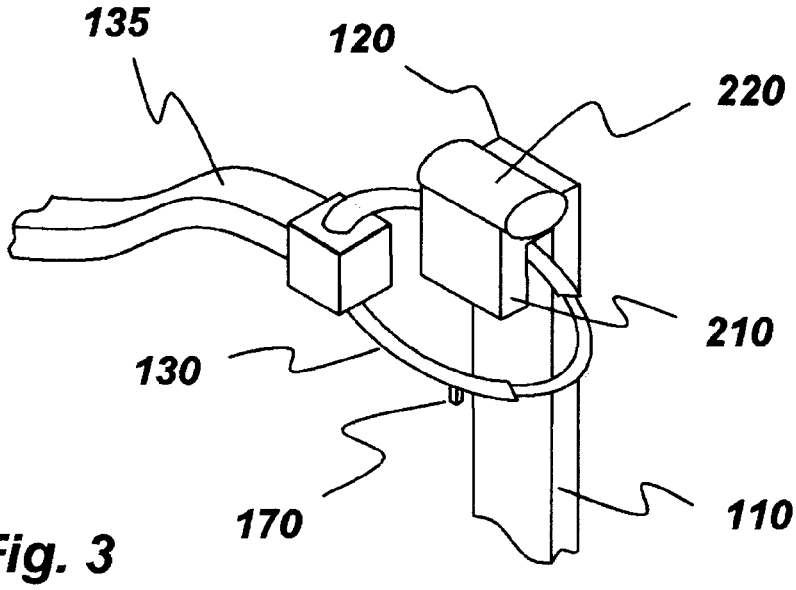
FIG. 3 illustrates an isometric schematic drawing in accordance with another more detailed embodiment of the embodiment of FIG. 1.
Figure 4:
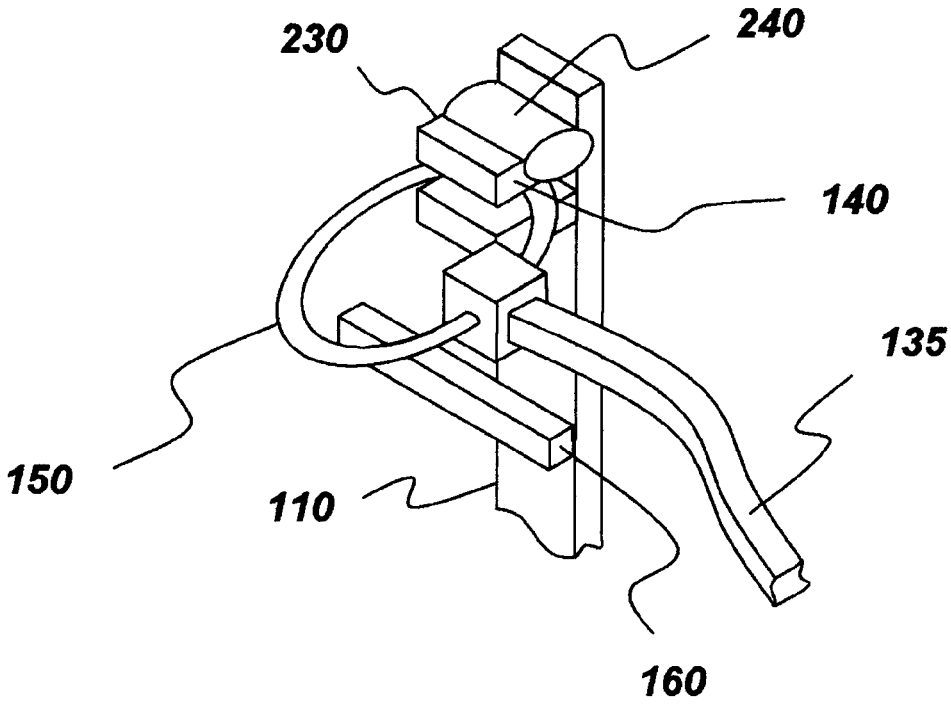
FIG. 4 illustrates an isometric schematic drawing in accordance with still another more detailed embodiment of the embodiment of FIG. 1.

In accordance with another more detailed embodiment of the embodiment of FIG. 1, FIG. 3 illustrates an isometric schematic drawing wherein clasp holder 120 further comprises a clasp jaw 210 and a clasp spring 220. In operation, clasp spring 220 applies a holding force to clasp jaw 210.

In accordance with another more detailed embodiment of the embodiment of FIG. 1, FIG. 3 illustrates an isometric schematic drawing wherein eyelet holder 140 further comprises an eyelet jaw 230 and an eyelet spring 240. In operation, eyelet spring 240 applies a holding force to eyelet jaw 230.

While only certain features of the invention have been illustrated and described herein, many modifications and changes will occur to those skilled in the art. It is, therefore, to be understood that the appended claims are intended to cover all such modifications and changes as fall within the true spirit of the invention.

What is claimed is:

1. An apparatus comprising:

a handle;

a clasp holder mechanically coupled to said handle and adapted for holding a jewelry clasp;

an eyelet holder mechanically coupled to said handle and adapted for holding a jewelry eyelet; and a clasp operator mechanically coupled to said handle and adapted for operating an operating lever of said jewelry clasp, said handle being adapted for being deformed so as to operate said operating lever and to couple said jewelry clasp with said jewelry eyelet.

2. The apparatus of claim 1 wherein said clasp holder, said eyelet holder, and said clasp operator are integral with said handle.

3. The apparatus of claim 1 wherein said clasp operator comprises:

an operating linkage adapted for operating said operating lever; and an actuator adapted for actuating said operating linkage.

4. The apparatus of claim 3 wherein said operating linkage is further adapted for holding said operator lever in an open position and releasing said operating lever when actuated by said actuator.

5. The apparatus of claim 1 wherein said handle further comprises:

a clasp arm mechanically coupled to said clasp holder; and an eyelet arm mechanically coupled to said eyelet holder and to said clasp arm.

6. The apparatus of claim 5 further comprising a handle spring adapted for applying an opening force to said clasp arm and said eyelet arm.

7. The apparatus of claim 1 wherein said clasp holder further comprises:

a clasp jaw; and a clasp spring adapted for applying a holding force to said clasp jaw.

8. The apparatus of claim 1 wherein said eyelet holder further comprises:

an eyelet jaw; and an eyelet spring adapted for applying a holding force to said eyelet jaw.

9. An apparatus comprising:

a handle;

a clasp holder mechanically coupled to said handle and adapted for holding a jewelry clasp, an eyelet holder mechanically coupled to said handle and adapted for holding a jewelry eyelet; and a clasp operator mechanically coupled to said handle and adapted for operating an operating lever of said jewelry clasp, said handle being adapted for being deformed so as to operate said operating lever and to couple said jewelry clasp with said jewelry eyelet, said clasp holder, said eyelet holder, and said clasp operator being integral with said handle, said clasp operator comprising:

an operating linkage adapted for operating said operating lever; and an actuator adapted for actuating said operating linkage.

10. The apparatus of claim 9 wherein said operating linkage is further adapted for holding said operator lever in an open position and releasing said operating lever when actuated by said actuator.

11. The apparatus of claim 9 wherein said handle further comprises:

a clasp arm mechanically coupled to said clasp holder; and an eyelet arm mechanically coupled to said eyelet holder and to said clasp arm.

12. The apparatus of claim 11 further comprising a handle spring adapted for applying an opening force to said clasp arm and said eyelet arm.

13. The apparatus of claim 9 wherein said clasp holder further comprises:

a clasp jaw; and a clasp spring adapted for applying a holding force to said clasp jaw.

14. The apparatus of claim 9 wherein said eyelet holder further comprises:

an eyelet jaw; and an eyelet spring adapted for applying a holding force to said eyelet jaw.

* * * * *